US005589739A

United States Patent [19]

Goossens

[11] Patent Number: 5,589,739

[45] Date of Patent: Dec. 31, 1996

[54] HYBRID BALLAST FOR HIGH PRESSURE DISCHARGE LAMP

[75] Inventor: Hendrikus M. W. Goossens, Oss, Netherlands

[73] Assignee: U.S. Philips Corporation, New York, N.Y.

[21] Appl. No.: 516,806

[22] Filed: Aug. 18, 1995

[30] Foreign Application Priority Data

Aug. 24, 1994 [EP] European Pat. Off. ..... 94202427

[51] Int. Cl.[6] ..... H05B 37/00

[52] U.S. Cl. ..... 315/176; 315/206; 315/160; 315/209 R; 315/DIG. 2; 315/DIG. 7

[58] Field of Search ..... 315/176, 172, 315/174, 206, 209 R, 224, 219, 194, 307, 308, DIG. 2, DIG. 5, DIG. 7, 160, 163, 165, 166

[56] References Cited

U.S. PATENT DOCUMENTS 4,075,476 2/1978 Pitel ..... 315/209 R
4,187,448 2/1980 Kuroi et al. ..... 315/176
4,484,107 11/1984 Kaneda ..... 315/176
4,870,327 9/1989 Jorgenson ..... 315/307
5,270,618 12/1993 Nilssen ..... 315/176

*Primary Examiner*—Robert Pascal
*Assistant Examiner*—Haissa Philogene
*Attorney, Agent, or Firm*—Bernard Franzblau; Edward Blocker

[57] ABSTRACT

A circuit for operating a discharge lamp includes input terminals for connection to a supply voltage source and a first apparatus coupled to the input terminals for generating a low-frequency alternating current from a supply voltage delivered by the supply voltage source. A second apparatus is coupled to the input terminals for generating from the supply voltage a further current which is superimposed on the low-frequency alternating current. The polarity of the further current is the same as that of the low-frequency alternating current. As a result, instabilities do not arise in the discharge arc of a high-pressure discharge lamp operated by the circuit.

20 Claims, 1 Drawing Sheet

HYBRID BALLAST FOR HIGH PRESSURE DISCHARGE LAMP

BACKGROUND OF THE INVENTION

This invention relates to a circuit arrangement for operating a discharge lamp, comprising input terminals for connection to a supply voltage source, means I coupled to the input terminals for generating a low-frequency alternating current from a supply voltage delivered by the supply voltage source, and means II coupled to the input terminals for generating from the supply voltage a further current which is superimposed on the low-frequency alternating current.

Such a circuit arrangement is known from U.S. Pat. No. 4,187,448. The known circuit arrangement is supplied with a low-frequency AC voltage. The means I are formed by a ballast coil. The means II are formed by a DC-AC converter which generates a high-frequency alternating current which forms the further current. Since a discharge lamp operated by means of the circuit arrangement is provided with current both by the means I and the means II, the dimensions of the ballast coil can be chosen to be comparatively small. In addition, less stringent requirements can be imposed on the DC-AC converter than if this converter were to supply the complete lamp current. As a result, the DC-AC converter can be realised with comparatively inexpensive components. The circuit arrangement as a whole is thus less voluminous than a conventional ballast which comprises exclusively a ballast coil, and also less expensive than a completely electronic ballast which generates a lamp current comprising exclusively a high-frequency alternating current. It is, in addition, possible to render the current supplied by the DC-AC converter adjustable and thus to render the power consumed by the discharge lamp adjustable over a certain range. With the use of such a DC-AC converter in combination with a control loop it is possible to control the total power consumed by the discharge lamp at a substantially constant level independently of, for example, the amplitude of the supply voltage.

A disadvantage of the known circuit arrangement is that the discharge arc exhibits instabilities in some discharge lamps, more in particular in high-pressure discharge lamps, if the lamp current contains a high-frequency component within a lamp-dependent frequency range. These instabilities of the discharge arc render the known circuit arrangement unsuitable for operating such lamps.

SUMMARY OF THE INVENTION

An object of the invention is to provide a comparatively compact and inexpensive circuit arrangement for operating a high-pressure discharge lamp which causes substantially no instabilities in the discharge arc during lamp operation and which makes it possible to adjust the power consumed by the lamp over a certain range or control this power at a substantially constant level independently of, for example, the amplitude of the supply voltage.

According to the invention, a circuit arrangement as described in the opening paragraph is for this purpose characterized in that the further current has the same polarity as the alternating current.

Substantially no instabilities were found to arise in the discharge during the operation of a high-pressure discharge lamp by means of a circuit arrangement according to the invention. The circuit arrangement is in addition comparatively inexpensive and compact, while it is possible to adjust the power consumed by the high-pressure discharge lamp over a certain range via the means II.

A circuit arrangement according to the invention may be realised in an advantageous and comparatively simple manner in that the means II comprise a DC-DC converter. Since the DC-DC converter usually comprises a high-frequency operated switching element, the further current will often comprise a component of this high frequency. To achieve a further suppression of instabilities in the discharge, it is desirable to provide the circuit arrangement with a filter for filtering out high-frequency components from the sum of the low-frequency alternating current and the further current. If the circuit arrangement is provided with a DC-DC converter, it is comparatively simple to equip this converter with a transformer having two secondary windings, each secondary winding being connected in series with diode means and a switching element, and in addition to equip it with means IV for rendering the switching elements alternately conducting and non-conducting at the frequency of the low-frequency alternating current during lamp operation. During a half cycle of the low-frequency current, only one of the secondary windings provides the further current because the switching element in series with the other secondary winding is non-conducting. The diode means connected in series with the secondary winding providing the further current achieve that the further current is a direct current of the same polarity as the low-frequency current. When the DC-DC converter comprises a high-frequency operated switching element, it is possible to adjust the amplitude of the further current in that, for example, the duty cycle of the high-frequency operated switching element is adjusted. The configuration of such a circuit arrangement can be particularly simple when the means I at the same time form the means IV. In that case the switching elements are rendered conducting and non-conducting by the low-frequency current so that it is not necessary to include separate control circuits in the circuit arrangement for this purpose.

In a favourable embodiment of the circuit arrangement according to the invention, the DC-DC converter is of the flyback type. If the supply voltage is an AC voltage, such a DC-DC converter can be active over the entire range of instantaneous values of the supply voltage amplitude. This has a favourable effect, for example, on the power factor of the circuit arrangement. To keep the power consumed by the lamp substantially constant, the circuit arrangement may be provided with means V for keeping substantially constant the sum of the low-frequency alternating current and the further current averaged over half a low-frequency cycle.

BRIEF DESCRIPTION OF THE DRAWINGS

The invention will be explained in more detail with reference to the accompanying drawing of an embodiment.

In the drawing.

DESCRIPTION OF THE PREFERRED EMBODIMENTS

Figure 1:
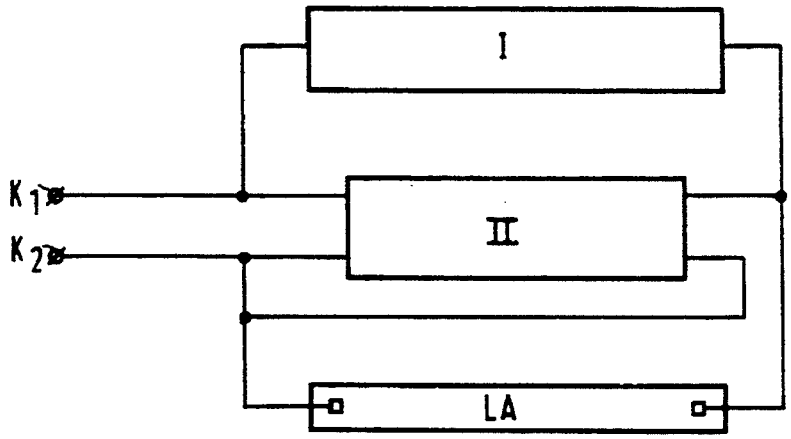
FIG. 1 is a block diagram of an embodiment of a circuit arrangement according to the invention, with a discharge lamp connected thereto.

In FIG. 1, K1 and K2 are input terminals for connection to a supply voltage source. I are means for generating a low-frequency alternating current from a supply voltage delivered by the supply voltage source. A first side of means I is connected to input terminal K1. Another side of means I is connected to a first side of discharge lamp La. A further side of discharge lamp La is connected to input terminal K2. Input terminals K1 and K2 are also connected to respective inputs of means II. A first output of means II is connected to the first side of discharge lamp La and a second output of means II is connected to the further side of discharge lamp La.

The operation of the circuit arrangement shown in FIG. 1 is as follows.

When the input terminals K1 and K2 are connected to the poles of a supply voltage source, the means I generate a low-frequency alternating current from the supply voltage delivered by the supply voltage source. The means II generate a further current which is superimposed on the low-frequency alternating current and which has the same polarity as the low-frequency alternating current. Since the current through the discharge lamp La is formed by the low-frequency alternating current and the further current, both the means I and the means II can be constructed in a comparatively simple manner, and can thus be of small volume and/or inexpensive. In addition, no instabilities arise in the discharge are of a high-pressure discharge lamp operated by the circuit arrangement because the further current has the same polarity as the low-frequency alternating current.

Figure 2:
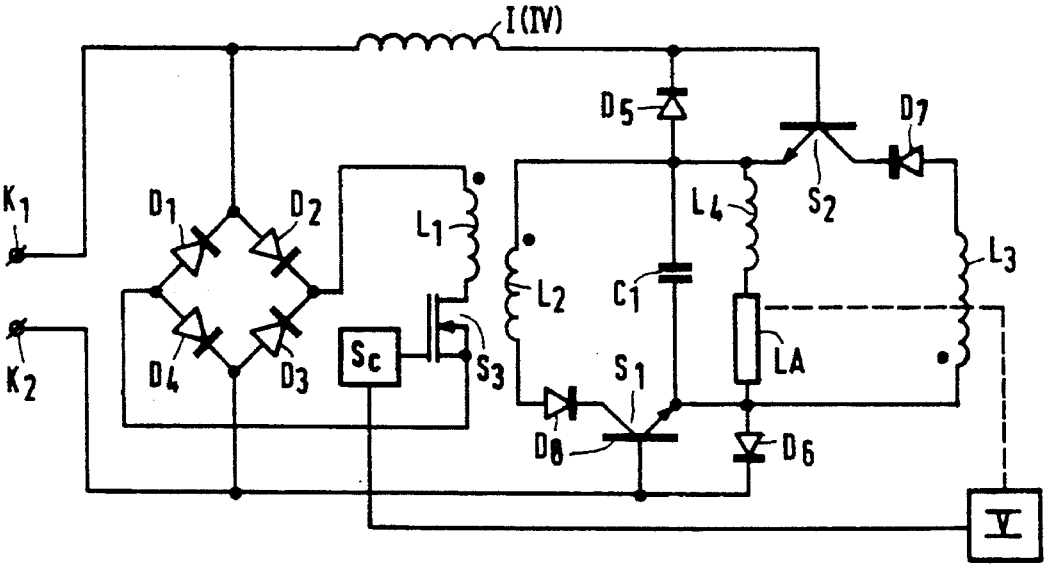
FIG. 2 shows a further embodiment in more detail.

In FIG. 2, K1 and K2 are input terminals for connection to a supply voltage source. The circuit arrangement is designed for the case in which the supply voltage delivered by the supply voltage source is a low-frequency AC voltage. Means I for generating a low-frequency alternating current are formed by coil I in this embodiment. Means II for generating a further current are formed by the remaining components, with the exception of circuit portion V, in this embodiment. Primary winding L1 in conjunction with secondary windings L2 and L3 forms a transformer T. Coil L4 and capacitor C1 form a filter. Control circuit SC, transformer T and switching element S3 together form a DC-DC converter of the flyback type. Circuit portion V provides a means for keeping the sum of the low-frequency alternating current and the further current averaged over half a low-frequency cycle substantially constant.

Input terminal K1 and input terminal K2 are connected to respective input terminals of a diode bridge formed by diodes D1, D2, D3 and D4. Outputs of the diode bridge are interconnected by a series circuit of primary winding L1 and switching element S3. A first side of secondary winding L2 is connected to a first end of coil L4 during lamp operation. A further end of coil L4 is connected to a first end of a discharge lamp La connected to the circuit arrangement. A further side of secondary winding L2 is connected to an anode of diode D8. A cathode of diode D8 is connected to a first main electrode of switching element S1. A further main electrode of the switching element S1 is connected to a further end of the discharge lamp La. A control electrode of switching element S1 is connected to input terminal K2 and to a cathode of diode D6. An anode of diode D6 is connected to the further end of the discharge lamp La and to a first side of secondary winding L3. A further side of secondary winding L3 is connected to an anode of diode D7. A cathode of diode D7 is connected to a first main electrode of switching element S2. A further main electrode of switching element S2 is connected to the first end of coil L4 and to an anode of diode D5. A cathode of diode D5 is connected to a control electrode of switching element S2 and to a first side of coil I. A further side of coil I is connected to input terminal K1. Capacitor C1 connects the first end of coil L4 to the further end of the discharge lamp. An input of circuit portion V is coupled (indicated with a broken line in FIG. 2) to the discharge lamp La such that a signal is present at the input of circuit portion V during lamp operation which is a measure of the current through the discharge lamp. The input of circuit portion V may be coupled for this purpose, for example, to a current sensor connected in series with the discharge lamp. An output of circuit portion V is connected to an input of a control circuit SC. An output of control circuit SC is connected to a control electrode of switching element S3.

The operation of the circuit arrangement shown in FIG. 2 is as follows.

When the input terminals K1 and K2 are connected to the poles of a supply voltage source which delivers a low-frequency AC voltage, this low-frequency AC voltage will cause a low-frequency current to flow through coil I and discharge lamp La. The frequency of this low-frequency alternating current is equal to the frequency of the low-frequency AC voltage. During a first half cycle of the low-frequency alternating current, in which the potential of the first end of the discharge lamp is higher than the potential of the second end, the low-frequency alternating current will flow through the control electrode and the further main electrode of the switching element S2 so that this switching element is conducting during the first half cycle of the low-frequency alternating current. The low-frequency alternating current also flows through diode D6 during the first half cycle. During a second half cycle of the low-frequency alternating current, in which the potential of the second end of the discharge lamp is higher than the potential of the first end, the low-frequency alternating current will flow through the control electrode and the further main electrode of the switching element S1 so that this switching element is conducting during the second half cycle of the low-frequency alternating current. The low-frequency alternating current also flows through diode D5 during the second half period. The switching element S3 is rendered conducting and non-conducting at a high frequency by means of a signal supplied by the control circuit SC during lamp operation. As a result of this, a further current flows through the discharge lamp during each first half cycle of the low-frequency current. This further current has the same polarity as the low-frequency alternating current, is supplied by secondary winding L3, and flows from the further side of the secondary winding L3 through diode D7, switching element S2, coil L4, discharge lamp La and capacitor C1 to the first side of the secondary winding L3. In addition, a further current flows through the discharge lamp during each second half cycle of the low-frequency current. This further current again has the same polarity as the low-frequency alternating current during each second half cycle of the low-frequency current. The further current is now supplied by secondary winding L2 during each second half cycle of the low-frequency alternating current and flows from the further side of secondary winding L2 through diode D8, switching element S1, discharge lamp La, and capacitor C1 to the first side of the secondary winding L2. The proportion of high-frequency components in the lamp current is kept at a comparatively low level by the filter action of coil L4 and capacitor C1 during each first and second half cycle. As high-frequency components are to be regarded first of all the high-frequency component of the further current which is introduced into the further current by the high-frequency switching of switching element S3 between conducting and non-conducting. The switching elements S1 and S2 are rendered conducting and non-conducting by the low-frequency alternating current during lamp operation at the frequency of the low-frequency current. Since this low-frequency alternating current is generated by means of coil I, the coil I also constitutes means for rendering the switching elements conducting and non-conducting during lamp operation at the frequency of the low-frequency alternating current. Separate control circuits for this purpose are therefore unnecessary in this embodiment. During lamp operation, the circuit portion V compares a measured value of the sum of the low-frequency alternating current and the further current averaged over half a cycle of the low-frequency alternating current with a desired value of this average sum. Depending on the outcome of this comparison, the circuit portion V adjusts the duty cycle of the signal supplied by the control circuit SC. It is achieved thereby that the current flowing through the discharge lamp is rendered highly independent of, for example, the supply voltage.

Figure 3:
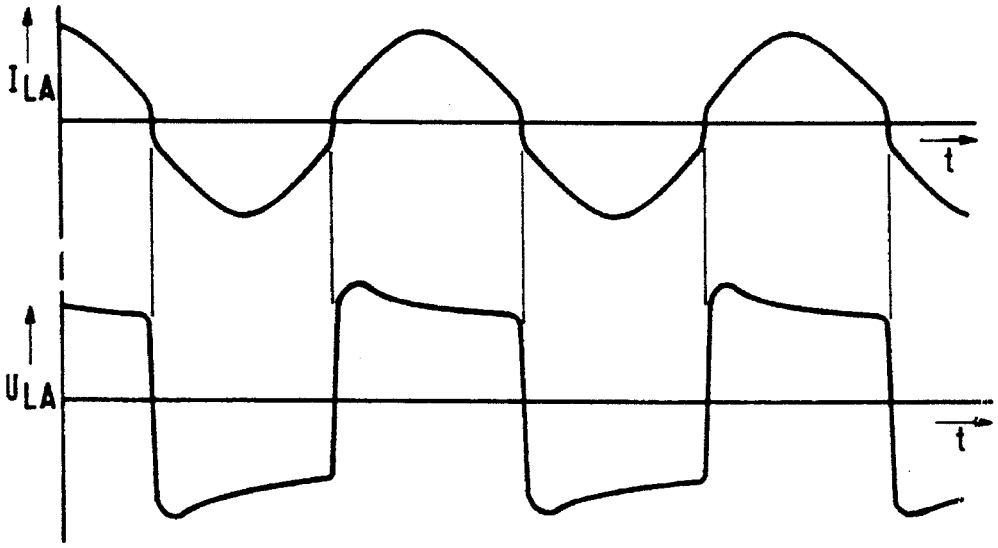
FIG. 3 shows the waveforms of the voltage across and the current through a discharge lamp operated by means of a circuit arrangement as shown in FIG. 2.

FIG. 3 shows the waveforms of the lamp voltage ($U_{LA}$) and the total current ($I_{LA}$) through the discharge lamp as a function of time for a circuit arrangement as shown in FIG. 2. The circuit arrangement was dimensioned so that, given a normal effective value of the supply voltage, the power supplied to the discharge lamp via the means I (coil I) was approximately 250 W. It was possible with means II to adjust the power supplied to the discharge lamp by the further current between 0 and 150 W. The discharge lamp was a high-pressure sodium lamp with a power rating of approximately 400 W. The supply voltage was a sinusoidal AC voltage with an effective value of 220 V and a frequency of 50 Hz.

I claim:

1. A circuit arrangement for operating a discharge lamp, comprising:

input terminals for connection to a supply voltage source, means coupled to the input terminals for generating a low-frequency alternating current from a supply voltage delivered by the supply voltage source, means coupled to the input terminals for generating from the supply voltage a further current which is superimposed on the low-frequency alternating current, and means for supplying said low-frequency alternating current and said superimposed further current to the discharge lamp such that the further current has the same polarity as the alternating current.

2. A circuit arrangement as claimed in claim 1, wherein the means for generating the further current comprise a DC-DC converter.

3. A circuit arrangement as claimed in claim 2, wherein the DC-DC converter includes a transformer having two secondary windings, each secondary winding being connected in series with diode means and a respective switching element, and means for driving the switching elements alternately conducting and non-conducting at the frequency of the low-frequency alternating current during lamp operation.

4. A circuit arrangement as claimed in claim 3, wherein the means for generating a low-frequency alternating current at the same time form the means for driving the switching elements.

5. A circuit arrangement as claimed in claim 3, wherein the DC-DC converter comprises a flyback type converter.

6. A circuit arrangement as claimed in claim 2, wherein the circuit arrangement includes a filter for filtering out high-frequency components from the sum of the low-frequency alternating current and the further current.

7. A circuit arrangement as claimed in claim 1 further comprising: means for keeping substantially constant the sum of the low-frequency alternating current and the further current averaged over half a low-frequency cycle.

8. A circuit for controlling the operation of a discharge lamp comprising:

a pair of input terminals for connection to a source of supply voltage for the circuit, means coupled to said input terminals for deriving a low frequency alternating current from the supply voltage, a pair of output terminals for connection to a discharge lamp, means coupled to the input terminals for producing from the supply voltage a high frequency alternating current, and means for coupling said low frequency alternating current and said high frequency alternating current to said output terminals in a manner such that said high frequency alternating current has the same polarity as the low frequency alternating current.

9. The discharge lamp control circuit as claimed in claim 8 wherein said means for producing the high frequency alternating current comprises:

a transformer having a primary winding and first and second secondary windings, a first semiconductor controlled switching device coupled in series circuit with said transformer primary winding to said pair of input terminals, second and third semiconductor controlled switching devices, means for coupling said first and second secondary windings in first and second respective series circuits with said second and third semiconductor controlled switching devices and respective diode means to said pair of output terminals, first means coupled to respective control electrodes of the second and third semiconductor controlled switching devices for driving said switching devices alternately into conduction and non-conduction at the frequency of said low frequency alternating current, and second means coupled to a control electrode of the first semiconductor controlled switching device for driving said first switching device alternately into conduction and non-conduction at the frequency of said high-frequency alternating current.

10. The discharge lamp control circuit as claimed in claim 9 wherein said first driving means comprises an inductor coupling a first one of said pair of input terminals to the control electrode of the second semiconductor controlled switching device and a second one of said pair of input terminals to the control electrode of the third semiconductor controlled switching device.

11. The discharge lamp control circuit as claimed in claim 10 further comprising a high frequency filter coupled in said circuit so as to filter out high frequency AC components of current from said output terminals.

12. The discharge lamp control circuit as claimed in claim 9 further comprising:

a first diode coupled between a first one of said pair of output terminals and a first one of said pair of input terminals, and a second diode coupled between a second one of said pair of output terminals and a second one of said input terminals and with said first and second diodes connected with opposite polarity as seen from the pair of input terminals.

13. The discharge lamp control circuit as claimed in claim 9 wherein said second driving means comprises means responsive to current flow between said pair of output terminals for controlling conduction in the first semiconductor switching device via its control electrode in a manner so as to keep substantially constant the sum of the low-frequency and high-frequency alternating currents averaged over half a cycle of the low frequency alternating current.

14. The discharge lamp control circuit as claimed in claim 8 wherein said high frequency alternating current producing means comprises:

a semiconductor controlled switching device coupled to said pair of input terminals for controlling the supply of high frequency alternating current to the output terminals, and means responsive to current flow between said pair of output terminals for controlling conduction in the semiconductor switching device via its control electrode in a manner so as to keep substantially constant the sum of the low-frequency and high-frequency alternating currents averaged over half a cycle of the low frequency alternating current.

15. The discharge lamp control circuit as claimed in claim 8 further comprising means for adjusting the level of power produced by said high frequency alternating current producing means thereby to adjust lamp power of a discharge lamp connected to said pair of output terminals.

16. The discharge lamp control circuit as claimed in claim 8 wherein said means for producing the high frequency alternating current comprises first and second controlled semiconductor switching devices coupled to said pair of output terminals so as to alternately pass and block high frequency current flow to the pair of output terminals each during alternate half cycles of the low frequency alternating current, and wherein said first and second semiconductor switching devices are controlled via said low frequency alternating current deriving means.

17. The discharge lamp control circuit as claimed in claim 16 wherein said source of supply voltage comprises an AC voltage of said low frequency and said first and second semiconductor switching devices are controlled by coupling respective control electrodes thereof to respective ones of said pair of input terminals.

18. The discharge lamp control circuit as claimed in claim 17 wherein said low frequency alternating current deriving means further comprises an inductor coupling the control electrode of one of said first and second semiconductor switching devices to its respective one of said pair of input terminals.

19. The discharge lamp control circuit as claimed in claim 8 wherein said discharge lamp comprises a high pressure discharge lamp and said high frequency alternating current producing means supplies a direct current of the same polarity as said low frequency alternating current during a first half cycle of said low frequency alternating current and supplies a direct current of the same polarity as said low frequency alternating current during a second half cycle of said low frequency alternating current.

20. The discharge lamp control circuit as claimed in claim 17 wherein said first semiconductor controlled switching device is under control of the low frequency AC supply voltage for one half cycle thereof and said second semiconductor controlled switching device is under control of the low frequency AC supply voltage during the alternate half cycle thereof.

* * * * *